US005970615A

United States Patent [19]

Wall

[11] Patent Number: 5,970,615

[45] Date of Patent: Oct. 26, 1999

[54] COMBINED CUTTING AND THINNING SHEARS

[76] Inventor: Albert Wall, 515 S. Crescent, Lodi, Calif. 95240

[21] Appl. No.: 09/079,421

[22] Filed: Apr. 14, 1998

[51] Int. Cl.[6] ..... B26B 19/22; B26B 13/24

[52] U.S. Cl. ..... 30/195; 30/142; 30/226; 30/254; 30/341; D8/57

[58] Field of Search ..... 30/195, 226, 254, 30/145, 131, 146, 341; D8/57, 55; 7/131, 134, 135

[56] References Cited

U.S. PATENT DOCUMENTS

| | | | |
|---|---|---|---|
| 95,834 | 10/1869 | Price | 7/131 |
| 116,936 | 7/1871 | Eastren | 30/226 |
| D. 250,629 | 12/1978 | Backstrom et al. | D8/57 |
| D. 303,486 | 9/1989 | Wang | D8/57 |
| 312,292 | 2/1885 | Pribyl . | |
| 404,169 | 5/1889 | Clark | 30/226 |
| 422,670 | 3/1890 | Wallace . | |
| 574,178 | 12/1896 | Stebbins . | |
| 617,018 | 1/1899 | Henault | 30/226 |
| 738,994 | 9/1903 | Grant | 30/254 |
| 2,591,014 | 4/1952 | Sansom | 30/195 |
| 2,606,365 | 8/1952 | Pileggi | 30/195 |
| 3,831,277 | 8/1974 | Nagata . | |
| 5,107,591 | 4/1992 | Sato . | |
| 5,711,075 | 1/1998 | Wolf | 30/28 |

*Primary Examiner*—Hwei-Siu Payer
*Attorney, Agent, or Firm*—Jack Lo

[57] ABSTRACT

A pair of combined cutting and thinning shears is comprised of a pair of handles, a pair of cutting blades attached to respective front ends of the handles, and a pair of thinning blades attached to respective rear ends of the handles. The cutting blades are pivoted together at a position adjacent the handles. A guide tab on one of the thinning blades mate with the opposite thinning blade to ensure their proper alignment when closed. In a second embodiment, the handles include inside edges that are in constant engagement with each other throughout their entire range of movement to ensure alignment between the thinning blades. Both embodiments can be used to cut or thin hair by simply positioning hair between either the cutting blades or thinning blades.

5 Claims, 3 Drawing Sheets

COMBINED CUTTING AND THINNING SHEARS

BACKGROUND OF THE INVENTION

1. Field of the Invention

This invention relates generally to shears for cutting and thinning hair.

2. Prior Art

A pair of cutting shears for cutting hair typically includes a pair of blades with continuous if cutting edges for cutting all the hair positioned there between. In some hair styling techniques, the hair is thinned or reduced in bulk with a pair of thinning shears, which typically includes a blade with a continuous cutting edge, and another blade with alternating teeth and gaps in its cutting edge. The teeth cut the hair when the blades are closed, but the gaps leave some hair uncut, so that only about half the hair is cut in each stroke. A pair of thinning shears is shown in U.S. Pat. No. 5,107,591 to Sato. The thinning operation is often performed by hairdressers, but typical cutting shears and thinning shears are separate tools, so that hairdressers must frequently switch shears.

Various patents show cutting shears combined with other tools. U.S. Pat. No. 312,292 to Pribyl shows a pair of shears with a notched wheel pivotally attached to one of the finger rings for marking things. U.S. Pat. No. 422,670 to Wallace shows a pair of shears with a screwdriver blade attached to one of the finger rings, and a claw attached to the other finger ring for removing tacks. U.S. Pat. No. 574,178 to Stebbins shows a pair of shears with a screwdriver blade attached to one of the finger rings, and a can opener attached to the other finger ring. None of these shears can thin hair. U.S. Pat. No. 3,831,277 to Nagata shows a pair of shears with a pair of cutting blades mounted in parallel to a pair of thinning blades. A shifting piece is moved to lock or release the cutting blades relative to the thinning blades, so that the shears can either cut or thin, or cut and thin simultaneously. However, the shifting operation is confusing, so hair can easily be unintentionally cut or thinned if the blades are in the wrong position. The four blades mounted together substantially increase the thickness and weight of the tool, so that it is awkward to use. Their substantially different feel and operation make them difficult to learn, so that they are unlikely to be adopted by professional hairdressers, who cannot afford to be slowed down by an unfamiliar tool.

OBJECTS OF THE INVENTION

Accordingly, objects of the present combined cutting and thinning shears are:

- to provide the same feel as a pair of conventional cutting shears, so that they are easy to use for cutting hair;
- to enable both cutting and thinning, so that a user does not have to switch tools;
- to enable switching between cutting and thinning without being reconfigured or adjusted; and
- to enable switching between cutting and thinning without changing the grasp on the shears.

Further objects of the present invention will become apparent from a consideration of the drawings and ensuing description.

BRIEF SUMMARY OF THE INVENTION

A pair of combined cutting and thinning shears is comprised of a pair of handles, a pair of cutting blades attached to respective front ends of the handles, and a pair of thinning blades attached to respective rear ends of the handles. The cutting blades are pivoted together at a position adjacent the handles. A guide tab on one of the thinning blades mate with the opposite thinning blade to ensure their proper alignment when closed. In a second embodiment, the handles include inside edges that are in constant engagement with each other throughout their entire range of movement to ensure alignment between the thinning blades. Both embodiments can be used to cut or thin hair by simply positioning hair between either the cutting blades or thinning blades.

BRIEF DESCRIPTION OF THE SEVERAL VIEWS OF THE DRAWING

FIG. 3A is a sectional view of the shears, taken along line 3A—3A in FIG. 3.

Figure 1:
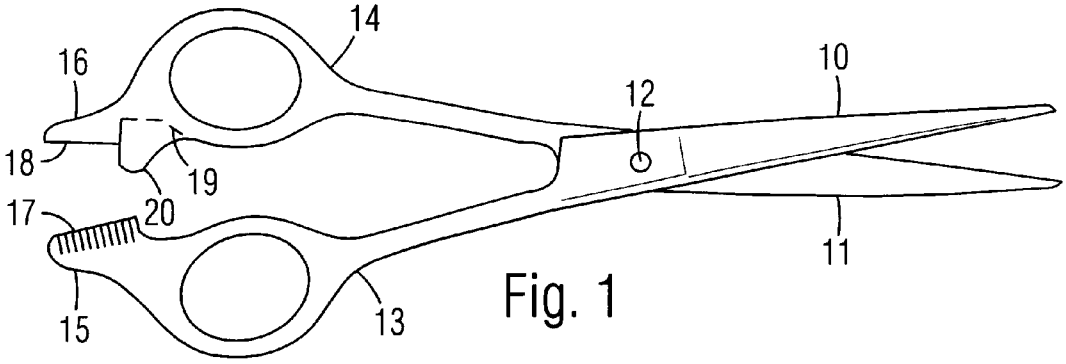
FIG. 1 is a right side view of a first embodiment of a combined cutting and thinning shears in an open position.

| DRAWING REFERENCE NUMERALS | |
|---|---|
| 10. Cutting Blade | 11. Cutting Blade |
| 12. Pivot | 13. Handle |
| 14. Handle | 15. Thinning Blade |
| 16. Thinning Blade | 17. Gapped Cutting Edge |
| 18. Continuous Cutting Edge | 19. Guide Slot |
| 20. Guide Tab | 30. Cutting Blade |
| 31. Cutting Blade | 32. Pivot |
| 33. Handle | 34. Handle |
| 35. Thinning Blade | 36. Thinning Blade |
| 37. Gapped Cutting Edge | 38. Gapped Cutting Edge |
| 39. Inside Edge | 40. Inside Edge |

DETAILED DESCRIPTION OF THE INVENTION

FIGS. 1–4

Figure 2:
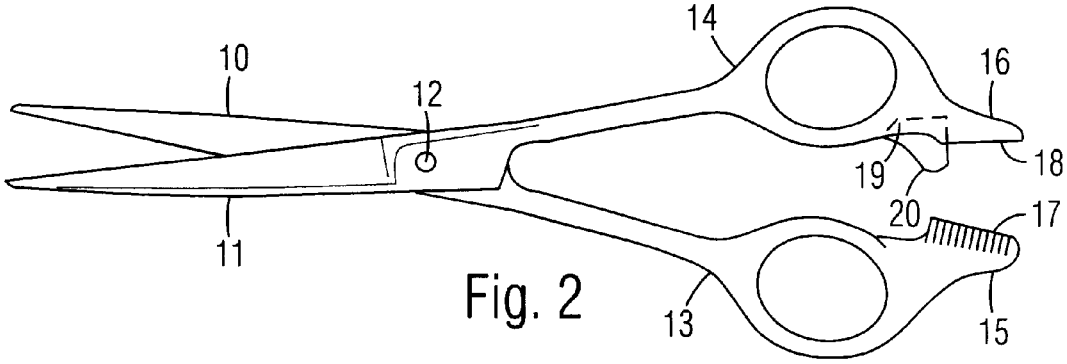
FIG. 2 is a left side view of the shears in the open position.

A first embodiment of the combined cutting and thinning shears is shown in the side views in FIGS.1 and 2 in an open position. It includes a front pair of cutting blades 10 and 11 positioned laterally together and attached to respective front ends of a pair of handles 13 and 14. Cutting blades 10 and 11 are pivoted together by a pivot 12 preferably at a position adjacent handles 13 and 14. A rear pair of thinning blades 15 and 16 are attached to respective rear ends of handles 13 and 14. Thinning blade 15 preferably includes a gapped cutting edge 17, and thinning blade 16 preferably includes a continuous cutting edge 18. A guiding means or guide tab 20 has a proximal end attached to a side of thinning blade 16, and a distal end diverging away from the side of thinning blade 16. A guide slot 19 is thus formed between guide tab 20 and thinning blade 16, as shown in the sectional view in FIG. 3A.

Figure 3:
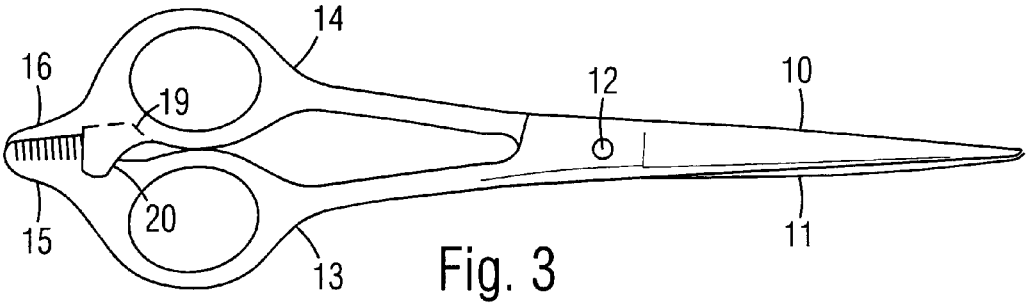
FIG. 3 is a right side view of the shears in a closed position.
Figure 4:
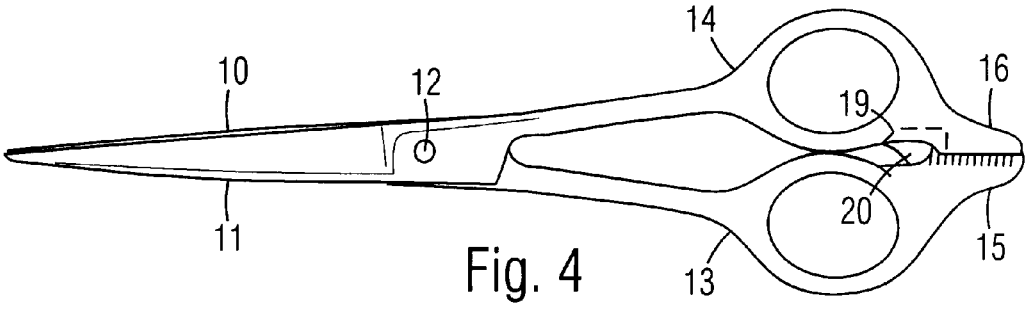
FIG. 4 is a left side view of the shears in the closed position.

The shears are shown in a closed position in the side views in FIGS. 3 and 4. During closing, as thinning blade 15 is brought toward thinning blade 16, thinning blade 15 is guided by guide tab 20 into guide slot 19 and thus proper engagement with thinning blade 16. The present shears are gripped and used to cut hair in the same fashion as a pair of conventional cutting shears, so that they are immediately familiar to users. The same shears are used to thin hair by simply positioning hair between thinning blades 15 and 16, and closing the thinning blades on the hair. The same grip on the shears is maintained during both cutting and thinning, so that switching operations is very convenient.

Figure 5:
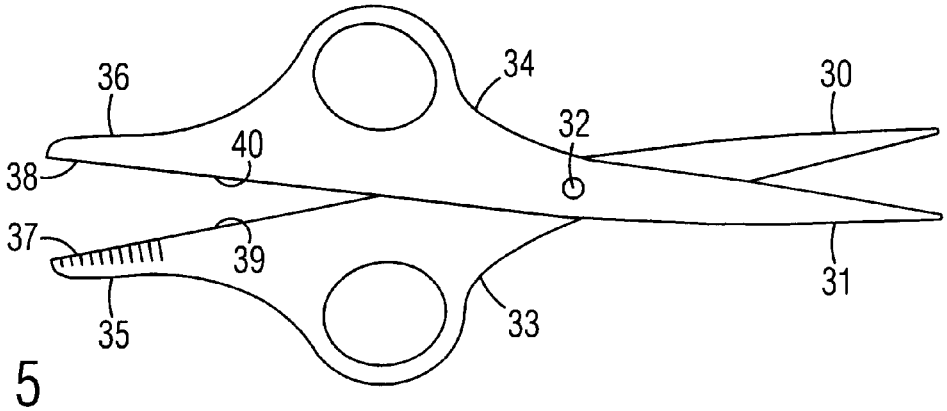
FIG. 5 is a right side view of a second embodiment of the shears in an open position.
Figure 6:
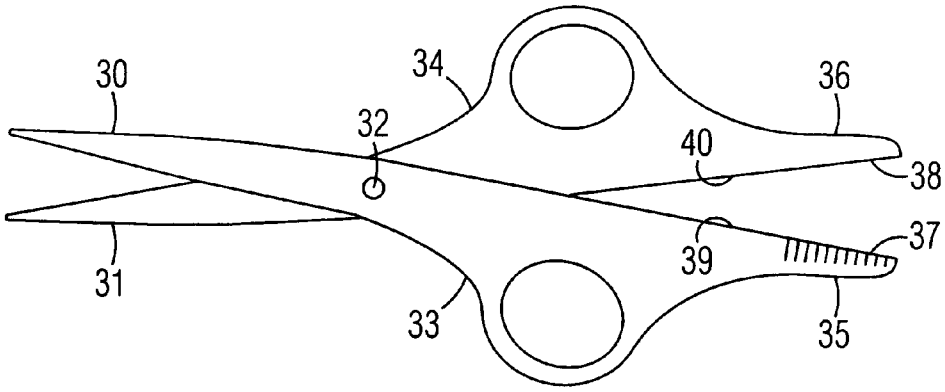
FIG. 6 is a left side view of the shears in the open position.
Figure 7:
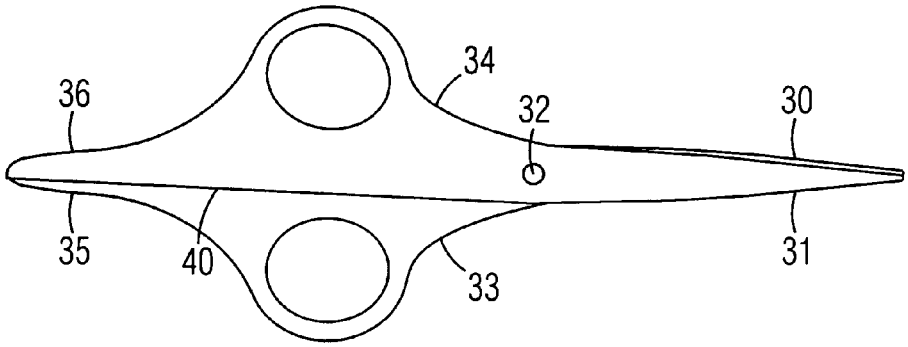
FIG. 7 is a right side view of the shears in a closed position.
Figure 8:
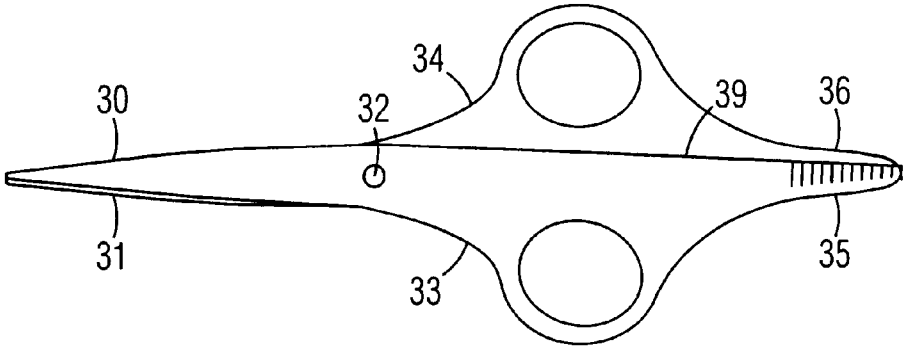
FIG. 8 is a left side view of the shears in the closed position.

FIGS. 5–9:

A second embodiment of the combined cutting and thinning shears is shown in the side views in FIGS. 5 and 6 in an open position, and in FIGS. 7 and 8 in a closed position. It includes a front pair of cutting blades 30 and 31 positioned laterally together and attached to respective front ends of a pair of handles 33 and 34. Cutting blades 30 and 31 are pivoted together by a pivot 32 at a position adjacent handles 33 and 34. A rear pair of thinning blades 35 and 36 are attached to respective rear ends of handles 33 and 34. Thinning blade 35 preferably includes a gapped cutting edge 37, and thinning blade 36 preferably includes a continuous cutting edge 38. Handles 33 and 34 respectively include guiding means or inside edges 39 and 40 that overlap each other substantially along the entire length of the handles when the shears are closed. Inside edges 39 and 40 are in constant engagement with each other throughout their entire range of movement. The example shown is arranged for a right hand. Handle 33 thus comprises a finger-engaging handle, and handle 34 thus comprises a thumb-engaging handle.

Figure 9:
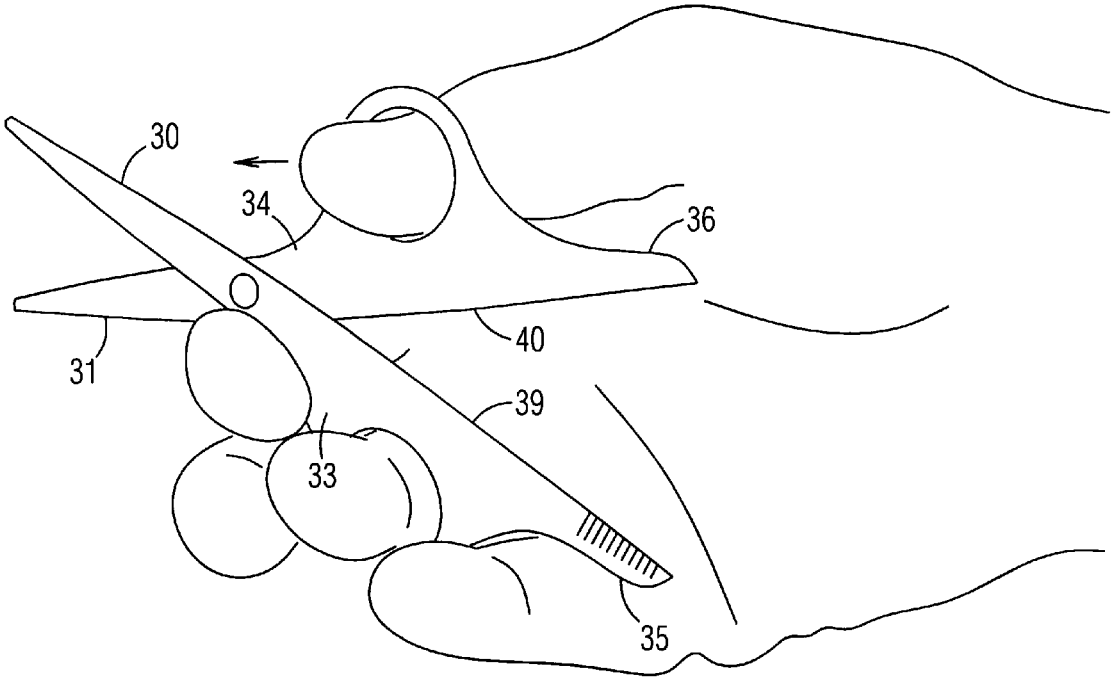
FIG. 9 is a side perspective view of the shears in use.

Thumb-engaging handle 34 is arranged to be laterally closer to the thumb than finger-engaging handle 33, as shown in FIG. 9. When the shears are gripped by a hand, the thumb has a natural tendency to push sideways in the direction indicated by the arrow. Inside edge 40 of thumb-engaging handle 34 is thus pushed into engagement with inside edge 39 of finger-engaging handle 33. As the shears are closed, inside edges 39 and 40 are in constant engagement with each other, and are kept in engagement by the pressure of the thumb, so that proper alignment between thinning blades 35 and 36 is ensured.

SUMMARY AND SCOPE

Accordingly, a pair of combined cutting and thinning shears is provided. It provides the same feel as a pair of conventional cutting shears, so that they are easy to use for cutting hair. It enables both cutting and thinning, so that a user does not have to switch tools. It enables switching between cutting and thinning without being reconfigured or adjusted. It also enables switching between cutting and thinning without changing the grip on the shears.

Although the above description is specific, it should not be considered as a limitation on the scope of the invention, but only as an example of the preferred embodiment. Many substitutes and variations are possible within the teachings of the invention. For example, the guide tab may be attached to the opposite thinning blade. Both thinning blades may include a gapped cutting edge as long as the gaps on opposite blades are aligned. Other types of thinning blades made be provided. The inside edges of the handles may overlap for a somewhat shorter length but still maintain their ability to guide the thinning blades into proper alignment. The pivot may be attached to the handles instead of the blades. The lateral positioning of the blades and handles may be reversed for use by a left hand. Therefore, the scope of the invention should be determined by the appended claims and their legal equivalents, not by the examples given.

I claim:

1. A pair of shears, comprising:

a pair of handles having corresponding front ends and rear ends;

a pair of front blades attached to respective front ends of said handles, said front blades having corresponding inside cutting edges, said front blades pivoting about a pivot relative to each other between an open position and a closed position;

a pair of rear blades attached to respective rear ends of said handles, said rear blades having corresponding inside cutting edges, said rear blades pivoting about said pivot relative to each other between an open position and a closed position, said rear blades being separated by said handles from said front blades to positively avoid cutting with said rear blades when said front blades are intended to be used, and to positively avoid cutting with said front blades when said rear blades are intended to be used; and a guide tab with a proximal end attached to a side of a first one of said rear blades, and a distal end diverging away from said side of said first one of said rear blades, a guide slot being defined between said guide tab and said first one of said rear blades, when said rear blades are closed, a second one of said rear blades is moved into said guide slot and positioned between said guide tab and said first one of said rear blades, said guide tab guiding said second one of said rear blades into proper engaging alignment with said first one of said rear blades.

2. A pair of shears, comprising:

a pair of handles having corresponding front ends and rear ends;

a pair of front blades attached to respective front ends of said handles, said front blades having corresponding inside cutting edges, said front blades pivoting about a pivot relative to each other between an open position and a closed position;

a pair of rear blades attached to respective rear ends of said handles, said rear blades having corresponding inside cutting edges, said rear blades pivoting about said pivot relative to each other between an open position and a closed position, said rear blades being separated by said handles from said front blades to positively avoid cutting with said rear blades when said front blades are intended to be used, and to positively avoid cutting with said front blades when said rear blades are intended to be used; and further including corresponding inside edges on said handles, said inside edges overlapping each other along at least most of said handles when said handles are closed, said inside edges being in constant engagement with each other throughout an entire range of pivoting movement thereof, said inside edges guiding said rear blades into proper engaging alignment when said rear blades are closed.

3. A pair of combined cutting and thinning shears, comprising:

a pair of handles having corresponding front ends and rear ends;

a pair of cutting blades attached to respective front ends of said handles, said cutting blades pivoting about a pivot relative to each other between an open position and a closed position for cutting hair;

a pair of thinning blades attached to respective rear ends of said handles, said thinning blades pivoting about said pivot relative to each other between an open position and a closed position for thinning hair; and a guide tab with a proximal end attached to a side of a first one of said thinning blades, and a distal end diverging away from said side of said first one of said thinning blades, a guide slot being defined between said guide tab and said first one of said thinning blades, when said thinning blades are closed, a second one of said thinning blades is moved into said guide slot and positioned between said guide tab and said first one of said thinning blades, said guide tab guiding said second one of said thinning blades into proper engaging alignment with said first one of said thinning blades.

4. The pair of combined cutting and thinning shears of claim 3, wherein one of said thinning blades includes a continuous cutting edge, and the other one of said thinning blades includes a gapped cutting edge.

5. A pair of combined cutting and thinning shears, comprising:

a pair of handles having corresponding front ends and rear ends;

a pair of cutting blades attached to respective front ends of said handles, said cutting blades pivoting about a pivot relative to each other between an open position and a closed position for cutting hair;

a pair of thinning blades attached to respective rear ends of said handles, said thinning blades pivoting about said pivot relative to each other between an open position and a closed position for thinning hair; and corresponding inside edges on said handles, said inside edges overlapping each other along at least most of said handles when said handles are closed, said inside edges being in constant engagement with each other throughout an entire range of pivoting movement thereof, said inside edges guiding said thinning blades into proper engaging alignment when said thinning blades are closed.

* * * * *